US010760750B1

(12) United States Patent
Hsu

(10) Patent No.: US 10,760,750 B1
(45) Date of Patent: Sep. 1, 2020

(54) RECESSED LIGHT HAVING SIDEWARD IRRADIATING FUNCTION

(71) Applicant: Dong Guan Jia Sheng Lighting Technology Co., Ltd. China, Dong-Guan, Guang-Dong (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/735,863

(22) Filed: Jan. 7, 2020

(51) Int. Cl.

| | |
|---|---|
| ***F21S 8/02*** | (2006.01) |
| ***F21V 13/10*** | (2006.01) |
| ***F21V 3/02*** | (2006.01) |
| ***F21V 17/10*** | (2006.01) |
| ***F21V 21/04*** | (2006.01) |
| *F21Y 115/10* | (2016.01) |
| *F21Y 105/18* | (2016.01) |

(52) U.S. Cl.
CPC ..... *F21S 8/026* (2013.01); *F21V 3/02* (2013.01); *F21V 13/10* (2013.01); *F21V 17/10* (2013.01); *F21V 21/04* (2013.01); *F21Y 2105/18* (2016.08); *F21Y 2115/10* (2016.08)

(58) Field of Classification Search
CPC ..... F21S 8/026; F21V 21/04–049
See application file for complete search history.

(56) References Cited

U.S. PATENT DOCUMENTS

2012/0002416 A1* 1/2012 Kong ..... F21V 7/0008 362/235
2013/0107570 A1* 5/2013 Liao ..... F21V 29/70 362/609

* cited by examiner

*Primary Examiner* — Sean P Gramling
(74) *Attorney, Agent, or Firm* — Karin L. Williams; Mayer & Williams PC

(57) ABSTRACT

A recessed light includes a top board, a main body, a reflector, a plurality of retaining mechanisms, a shading plate, a transparent plate, a light output plate, an LED ring, a bottom bracket, and a plurality of elastic strips. The light output plate, the transparent plate, and the shading plate are sequentially mounted in the main body. The LED ring is mounted in the main body, and surrounds the transparent plate. The top board is located above the main body. The reflector is located under the main body. The retaining mechanisms connect the top board and the bottom bracket. Each of the retaining mechanisms includes a connecting piece and a locking piece removably mounted on the connecting piece. The elastic strips are mounted on the main body. The reflector is retained by the elastic strips.

9 Claims, 5 Drawing Sheets

RECESSED LIGHT HAVING SIDEWARD IRRADIATING FUNCTION

BACKGROUND OF THE INVENTION

1. Field of the Invention

The present invention relates to an illuminating apparatus and, more particularly, to a recessed light.

2. Description of the Related Art

A conventional recessed light is mounted on a ceiling or a wall to provide an illuminating function. However, the conventional recessed light cannot provide a sideward irradiating function, such that the conventional recessed light does not satisfy the demands of different environment of assembly, thereby limiting the versatility of the conventional recessed light. Thus, the conventional recessed light cannot satisfy the requirements of different consumers.

BRIEF SUMMARY OF THE INVENTION

The primary objective of the present invention is to provide a recessed light having a sideward irradiating function.

In accordance with the present invention, there is provided a recessed light comprising a top board, a main body, a reflector, a plurality of retaining mechanisms, a shading plate, a transparent plate, a light output plate, an LED ring, a bottom bracket, and a plurality of elastic strips. The light output plate, the transparent plate, and the shading plate are sequentially mounted in the main body. The LED ring is mounted in the main body, and surrounds the transparent plate. The top board is mounted on and located above the main body. The reflector is mounted on and located under the main body. The main body is locate between the top board and the reflector. The retaining mechanisms connect the top board and the bottom bracket. Each of the retaining mechanisms includes a connecting piece and a locking piece removably mounted on the connecting piece. The connecting piece has a middle provided with a T-shaped mounting slot. The locking piece includes a front stop and a side locking portion connected with the front stop. The side locking portion extends from the front stop rearward and downward. The front stop of the locking piece is locked in the mounting slot of the connecting piece.

The elastic strips are mounted on the main body. The reflector is retained by the elastic strips.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
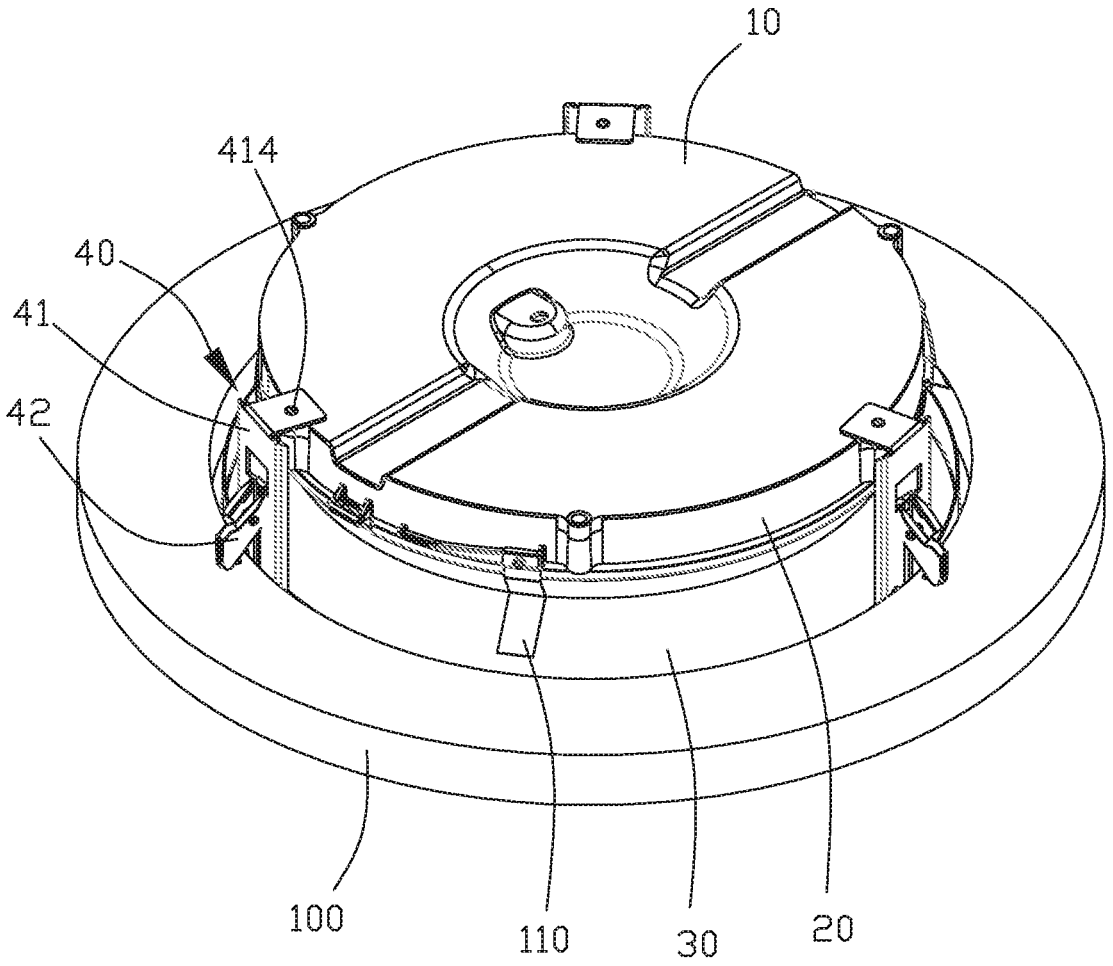
FIG. 1 is a perspective view of a recessed light mounted on a ceiling in accordance with the preferred embodiment of the present invention.
Figure 2:
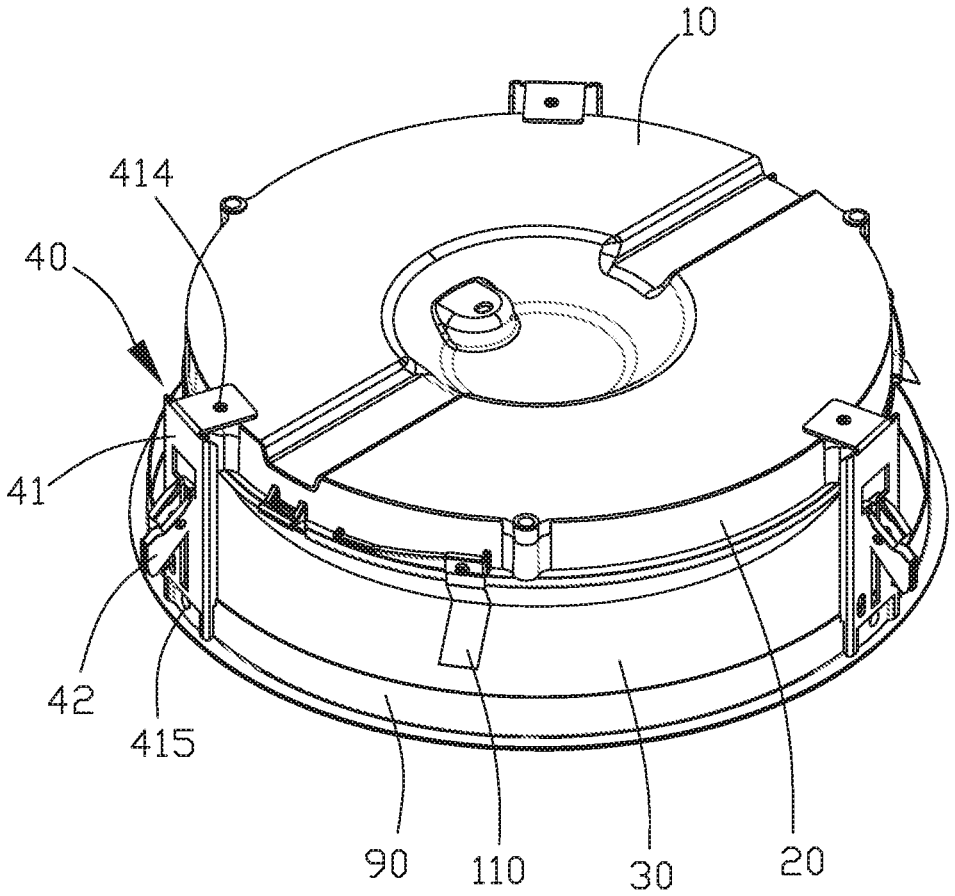
FIG. 2 is a perspective view of the recessed light in accordance with the preferred embodiment of the present invention.
Figure 3:
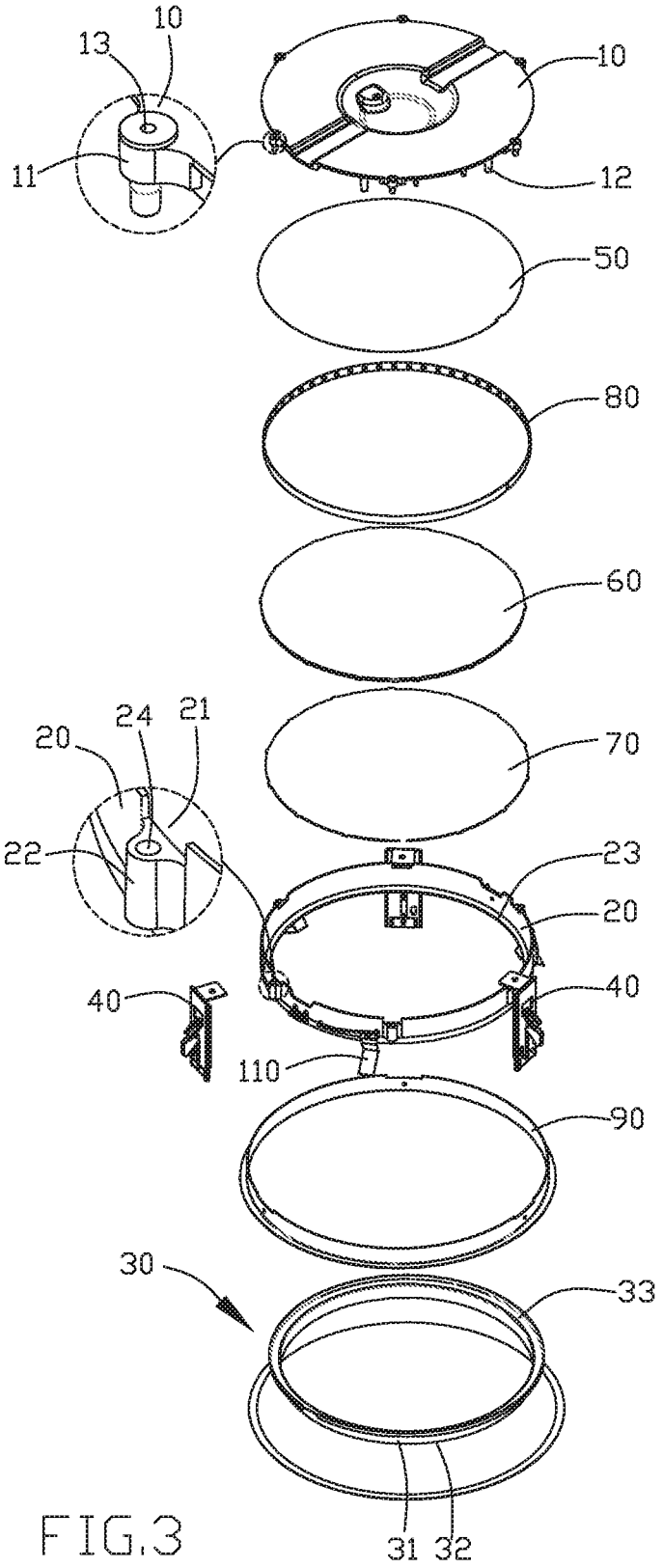
FIG. 3 is an exploded perspective view of the recessed light in accordance with the preferred embodiment of the present invention.
Figure 4:
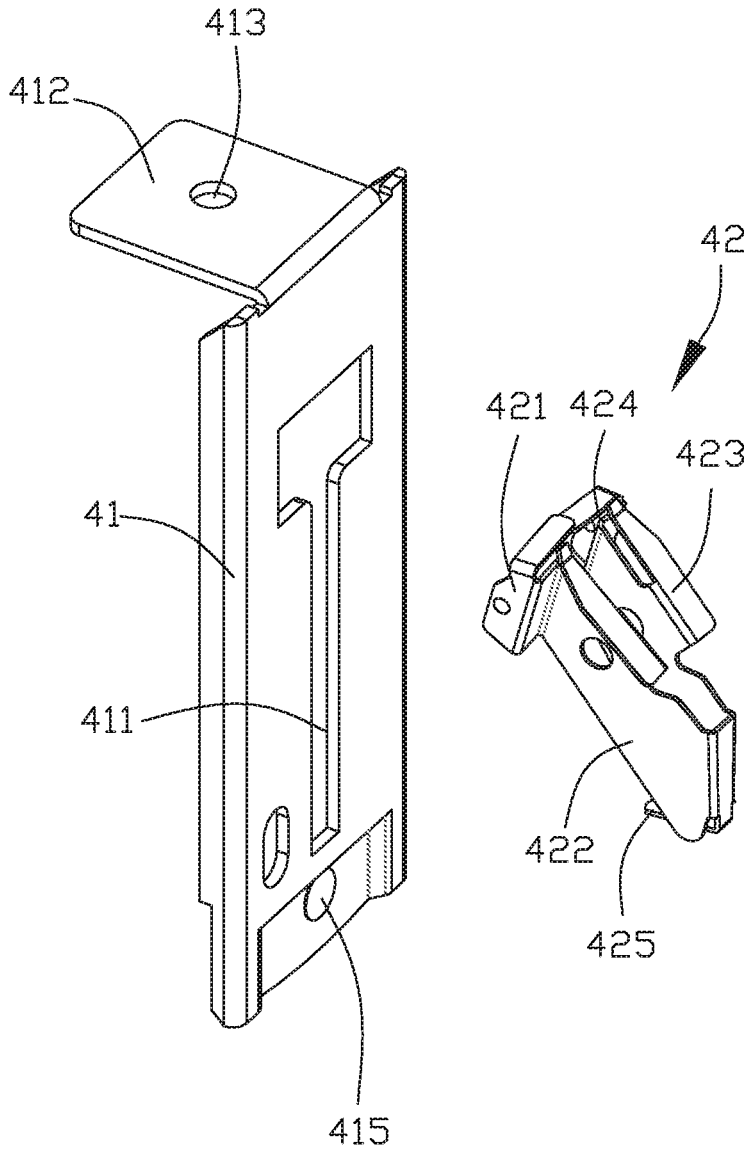
FIG. 4 is an exploded perspective view of a retaining mechanism of the recessed light in accordance with the preferred embodiment of the present invention.
Figure 5:
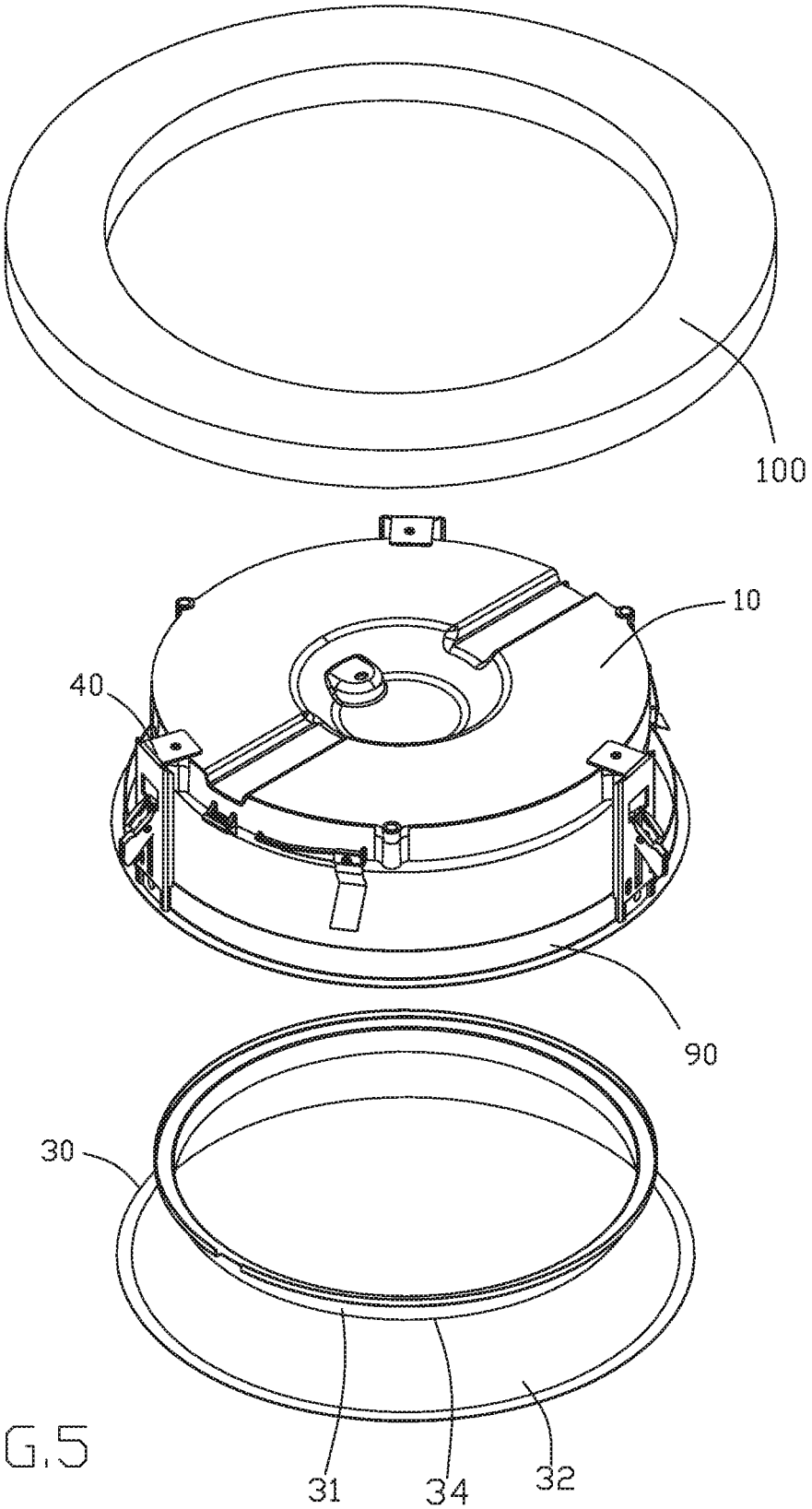
FIG. 5 is a partial exploded perspective view of the recessed light in accordance with the preferred embodiment of the present invention.

Referring to FIGS. 1-5, a recessed light in accordance with the preferred embodiment of the present invention is attached to a ceiling 100 or a lamp seat, and comprises a top board 10, a main body 20, a reflector 30, a plurality of retaining mechanisms 40, a shading plate (or light screen or light blind) 50, a transparent plate (or light permeable plate) 60, a light output plate 70, an LED ring (or belt) 80, a bottom bracket (or ring) 90, and a plurality of elastic strips 110.

The light output plate 70, the transparent plate 60, and the shading plate 50 are sequentially mounted in the main body 20. The LED ring 80 is mounted in the main body 20, and surrounds the transparent plate 60. The top board 10 is mounted on and located above the main body 20. The reflector 30 is mounted on and located under the main body 20. The main body 20 is locate between the top board 10 and the reflector 30.

The retaining mechanisms 40 are mounted between the top board 10 and the bottom bracket 90 and connect the top board 10 and the bottom bracket 90. Thus, the bottom bracket 90 is attached to the main body 20 by the retaining mechanisms 40. Each of the retaining mechanisms 40 has an end locked on the ceiling 100.

Each of the retaining mechanisms 40 includes a connecting piece 41 and a locking piece 42 removably mounted on the connecting piece 41. The connecting piece 41 has a middle provided with a T-shaped mounting slot 411.

The locking piece 42 includes a front stop 421 and a side locking portion 422 connected with the front stop 421. The side locking portion 422 extends from the front stop 421 rearward and downward, with an angle being defined between the side locking portion 422 and the front stop 421. The front stop 421 of the locking piece 42 is locked in the mounting slot 411 of the connecting piece 41.

The elastic strips 110 are mounted on the main body 20. The reflector 30 is retained by the elastic strips 110. Thus, the reflector 30 is secured to the main body 20 by the elastic strips 110. The reflector 30 is removed from the main body 20, such that the user changes reflectors 30 of different colors according to the requirement.

In the preferred embodiment of the present invention, the side locking portion 422 has an upper end provided with a plurality of resting edges 423 extending toward the front stop 421. Each of the resting edges 423 extends in a direction parallel with that of the side locking portion 422.

In the preferred embodiment of the present invention, each of the resting edges 423 has an end provided with an abutting portion 424 that is bent and extends upward. A restriction space is defined between the abutting portion 424 and the front stop 421.

In the preferred embodiment of the present invention, the side locking portion 422 is provided with a pressing piece 425 having an L-shaped configuration. The pressing piece 425 presses the ceiling 100.

In the preferred embodiment of the present invention, the top board 10 has a periphery provided with a plurality of projections 11. Each of the projections 11 is provided with a first mounting hole 13. The main body 20 has an annular shape and has a periphery provided with a plurality of ribs 22 and a plurality of openings 21 corresponding to the ribs 22 respectively. Each of the ribs 22 is provided with a second mounting hole 24. The projections 11 of the top board 10 extend through the openings 21 of the main body 20 respectively, and the first mounting hole 13 of each of the projections 11 aligns with the second mounting hole 24 of each of the ribs 22.

In the preferred embodiment of the present invention, the main body 20 has a bottom provided with a support flange 23 extending radially and inward.

In the preferred embodiment of the present invention, the reflector 30 includes an annular connecting portion 31, a reflector body 32 extending and expanding outward from a bottom of the connecting portion 31, and an insertion groove 34 defined between the connecting portion 31 and the reflector body 32. Each of the elastic strips 110 has a configuration corresponding to that of the reflector 30. Each of the elastic strips 110 presses the reflector 30, and has an upper end secured to the main body 20, a bent middle inserted into and locked in the insertion groove 34 of the reflector 30, and an oblique lower end extending outward.

In the preferred embodiment of the present invention, the connecting portion 31 has a first end connected with the reflector body 32 and a second end provided with a receiving section 33 which extending outward and bent upward. The main body 20 has a lower end locked in the receiving section 33 of the reflector 30.

In the preferred embodiment of the present invention, the connecting piece 41 has an inverted L-shaped configuration, and has an upper end provided with a mounting portion 412 bent and extending outward. The mounting portion 412 of the connecting piece 41 of each of the retaining mechanisms 40 is mounted on the top board 10 and is provided with a fastening hole 413 aligning with the first mounting hole 13 of each of the projections 11.

In the preferred embodiment of the present invention, the connecting piece 41 has a lower end provided with a fixing hole 415.

In the preferred embodiment of the present invention, the top board 10 is provided with a plurality of locking pins 12 extending downward.

In the preferred embodiment of the present invention, the reflector 30 has a bottom abutting the bottom bracket 90.

In assembly, the light output plate 70, the transparent plate 60, and the shading plate 50 are sequentially mounted in the main body 20 and supported by the support flange 23. The LED ring 80 is mounted in the main body 20, and surrounds the transparent plate 60. The top board 10 is then mounted on the main body 20, and the locking pins 12 of the top board 10 are locked in the inner face of the main body 20. The projections 11 of the top board 10 extend through the openings 21 of the main body 20 respectively, and the first mounting hole 13 of each of the projections 11 aligns with the second mounting hole 24 of each of the ribs 22. The mounting portion 412 of the connecting piece 41 of each of the retaining mechanisms 40 is mounted on the top board 10, and the fastening hole 413 of the mounting portion 412 aligns with the first mounting hole 13 of each of the projections 11. Then, a plurality of fasteners 414 in turn extend through the fastening hole 413 of the connecting piece 41 of each of the retaining mechanisms 40, the first mounting hole 13 of each of the projections 11 of the top board 10, and the second mounting hole 24 of each of the ribs 22 of the main body 20, such that the retaining mechanisms 40, the top board 10, and the main body 20 are secured together. Then, the bottom bracket 90 is mounted on the retaining mechanisms 40. Then, a plurality of fasteners in turn extend through the fixing hole 415 of the connecting piece 41 of each of the retaining mechanisms 40, and a plurality of through holes of the bottom bracket 90, such that the bottom bracket 90 is secured to the retaining mechanisms 40.

Then, the top board 10 and the main body 20 are inserted through a mounting opening of the ceiling 100. Then, the locking piece 42 of each of the retaining mechanisms 40 extends toward the ceiling 100, and extends outward from a gap "A" (see FIG. 5) between the main body 20 and the bottom bracket 90. Then, the locking piece 42 of each of the retaining mechanisms 40 is mounted in the connecting piece 41. Then, the reflector 30 is pushed upward to pass the elastic strips 110, such that the bent middle of each of the elastic strips 110 is inserted into and locked in the insertion groove 34 of the reflector 30, the lower end of the main body 20 is locked in the receiving section 33 of the reflector 30, and the bottom of the reflector 30 rests on the bottom bracket 90.

Then, the front stop 421 of the locking piece 42 of each of the retaining mechanisms 40 is inserted into the mounting slot 411 of the connecting piece 41. Then, the locking piece 42 of each of the retaining mechanisms 40 is moved downward, such that the connecting piece 41 extends through the restriction space and is locked between the front stop 421 and the resting edges 423 of the locking piece 42, the abutting portion 424 of each of the resting edges 423 rests on the connecting piece 41, and the pressing piece 425 of the locking piece 42 presses the ceiling 100. Thus, the recessed light is mounted on the mounting opening of the ceiling 100, with the side locking portion 422 of each of the retaining mechanisms 40 being locked onto the top of the ceiling 100.

Accordingly, the light output plate 70, the transparent plate 60, and the shading plate 50 are sequentially mounted in the main body 20, and the LED ring 80 is mounted in the main body 20, and surrounds the transparent plate 60, such that the recessed light has a sideward irradiating function. In addition, the recessed light is assembled and disassembled easily and conveniently. Further, the reflector 30 can be removed from the main body 20, to facilitate the user changing reflectors 30 of different colors according to the requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A recessed light comprising:

a top board, a main body, a reflector, a plurality of retaining mechanisms, a shading plate, a transparent plate, a light output plate, an LED ring, a bottom bracket, and a plurality of elastic strips;

wherein:

the light output plate, the transparent plate, and the shading plate are sequentially mounted in the main body;

the LED ring is mounted in the main body, and surrounds the transparent plate;

the top board is mounted on and located above the main body;

the reflector is mounted on and located under the main body;

the main body is locate between the top board and the reflector;

the retaining mechanisms connect the top board and the bottom bracket;

each of the retaining mechanisms includes a connecting piece and a locking piece removably mounted on the connecting piece;

the connecting piece has a middle provided with a T-shaped mounting slot;

the locking piece includes a front stop and a side locking portion connected with the front stop;

the side locking portion extends from the front stop rearward and downward;

the front stop of the locking piece is locked in the mounting slot of the connecting piece;

the elastic strips are mounted on the main body; and the reflector is retained by the elastic strips.

2. The recessed light of claim 1, wherein:

the side locking portion has an upper end provided with a plurality of resting edges extending toward the front stop; and each of the resting edges extends in a direction parallel with that of the side locking portion.

3. The recessed light of claim 2, wherein each of the resting edges has an end provided with an abutting portion that is bent and extends upward, and a restriction space is defined between the abutting portion and the front stop.

4. The recessed light of claim 2, wherein the side locking portion is provided with a pressing piece having an L-shaped configuration.

5. The recessed light of claim 1, wherein:

the top board has a periphery provided with a plurality of projections;

each of the projections is provided with a first mounting hole;

the main body has an annular shape and has a periphery provided with a plurality of ribs and a plurality of openings corresponding to the ribs respectively;

each of the ribs is provided with a second mounting hole;

the projections of the top board extend through the openings of the main body respectively; and the first mounting hole of each of the projections aligns with the second mounting hole of each of the ribs.

6. The recessed light of claim 5, wherein the main body has a bottom provided with a support flange extending radially and inward.

7. The recessed light of claim 5, wherein:

the reflector includes an annular connecting portion, a reflector body expanding outward from a bottom of the connecting portion, and an insertion groove defined between the connecting portion and the reflector body;

each of the elastic strips has a configuration corresponding to that of the reflector; and each of the elastic strips presses the reflector, and has an upper end secured to the main body, a bent middle inserted into and locked in the insertion groove of the reflector, and a lower end extending outward.

8. The recessed light of claim 7, wherein the connecting portion has a first end connected with the reflector body and a second end provided with a receiving section which extending outward and bent upward, and the main body has a lower end locked in the receiving section of the reflector.

9. The recessed light of claim 5, wherein the connecting piece has an upper end provided with a mounting portion bent and extending outward, and the mounting portion of the connecting piece of each of the retaining mechanisms is mounted on the top board and is provided with a fastening hole aligning with the first mounting hole of each of the projections.

* * * * *